United States Patent [19]

Nalbach

[11] 4,122,876

[45] Oct. 31, 1978

[54] APPARATUS FOR FILLING CONTAINERS

[75] Inventor: John C. Nalbach, La Grange Park, Ill.

[73] Assignee: John R. Nalbach Engineering Co., Inc., Chicago, Ill.

[21] Appl. No.: 838,311

[22] Filed: Sep. 30, 1977

[51] Int. Cl.[2] ..... B65B 43/50

[52] U.S. Cl. ..... 141/150; 141/152; 141/177; 198/481

[58] Field of Search ..... 198/480, 481, 655; 222/288, 282, 434, 438; 141/71, 74, 78, 80, 129, 131, 135, 144, 145, 148, 149, 150, 152, 171, 172, 177, 270, 275–278, 324, 367, 374, 375, 376, 378, 392

[56] References Cited

U.S. PATENT DOCUMENTS

| | | | |
|---|---|---|---|
| 2,055,075 | 9/1936 | Gardner | 141/177 X |
| 3,825,043 | 7/1974 | Fechheimer | 141/152 X |

*Primary Examiner*—Richard E. Aegerter

*Assistant Examiner*—Frederick R. Schmidt

[57] ABSTRACT

An apparatus for filling like containers with a like measured amount of divided matter is herein disclosed. The apparatus includes a base, to which a jack is connected. A drive and a feed system are also mounted on the base. A removable rotary dispenser is drivingly connected to the drive. A material reservoir is connected to a portion of the jack. The material reservoir is mounted above and in frictional contact with the removable rotary dispenser. A container elevator is connected to the base. The feed system supplies a plurality of like containers for filling the rotary removable dispenser. The container elevator lifts the like containers into contact with a portion of the removable rotary dispenser for filling. The jack is adapted to move the material reservoir away from the removable rotary dispenser so that the removable rotary dispenser may be quickly and easily changed to allow efficient use of the apparatus with different size containers.

14 Claims, 9 Drawing Figures

FIG. 5
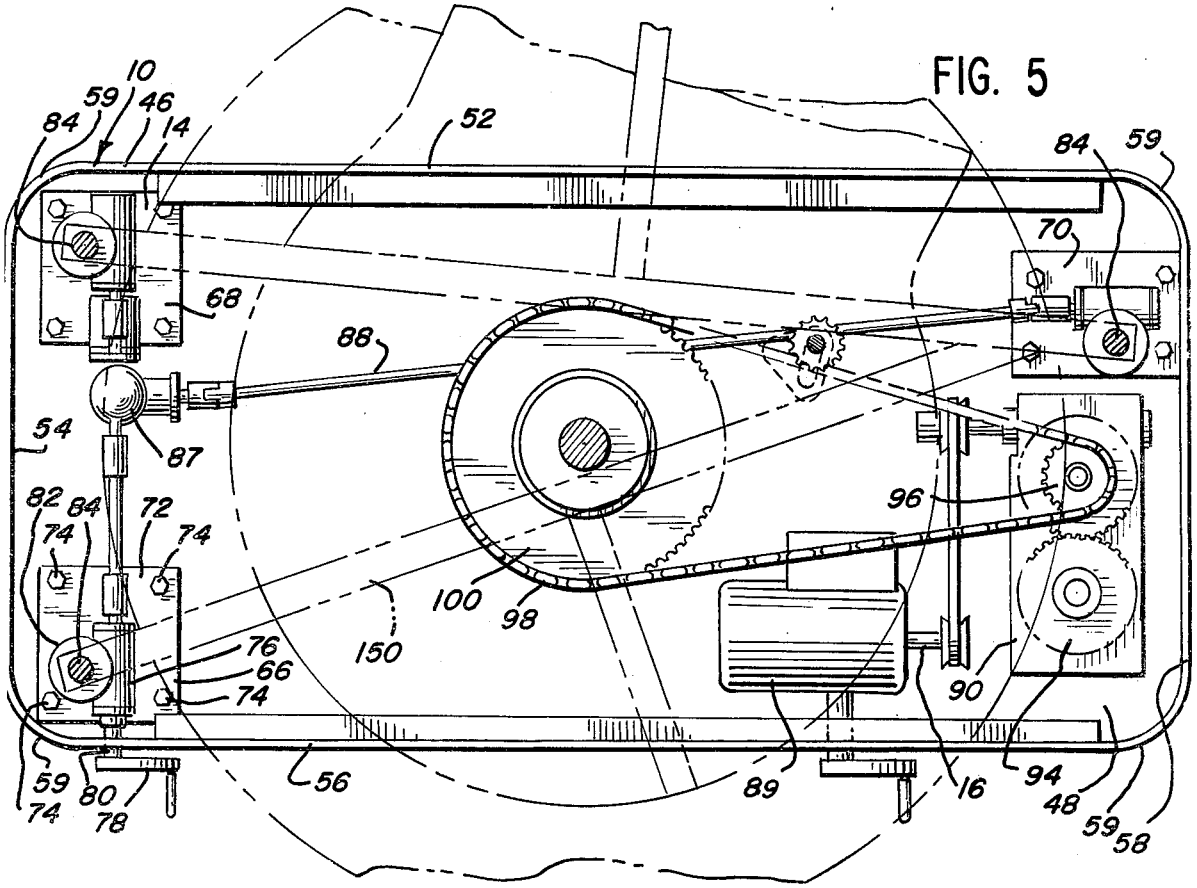
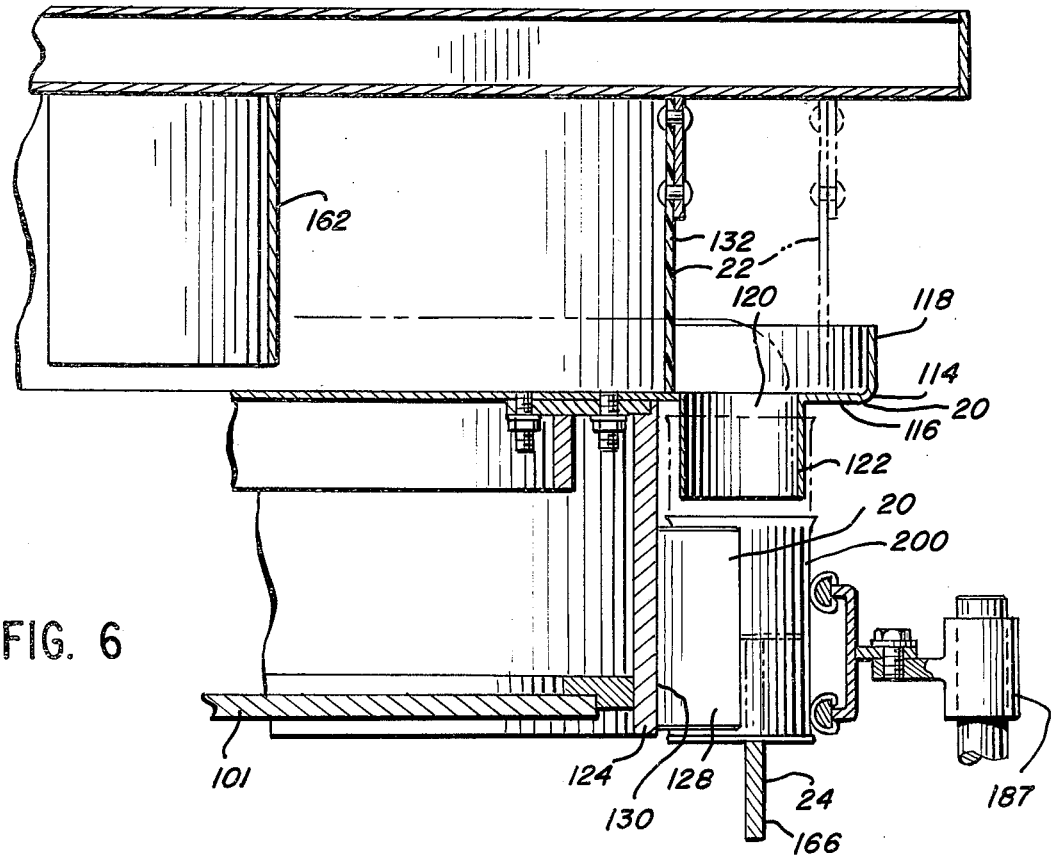
FIG. 6

FIG. 8
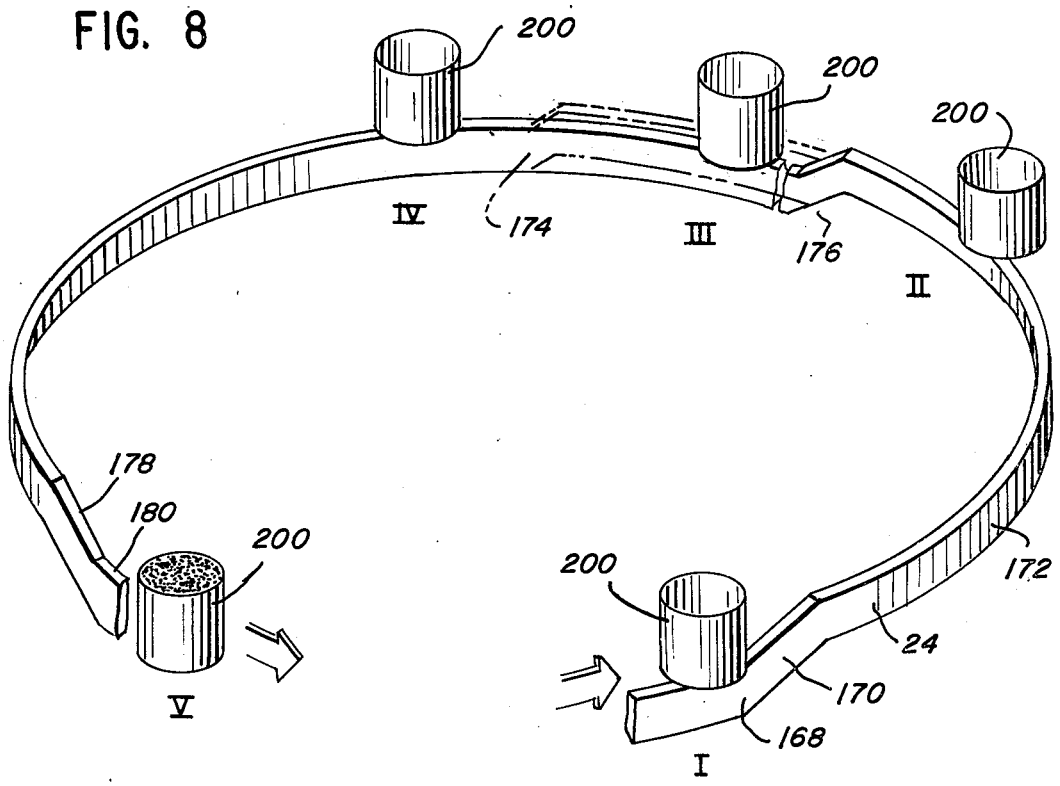
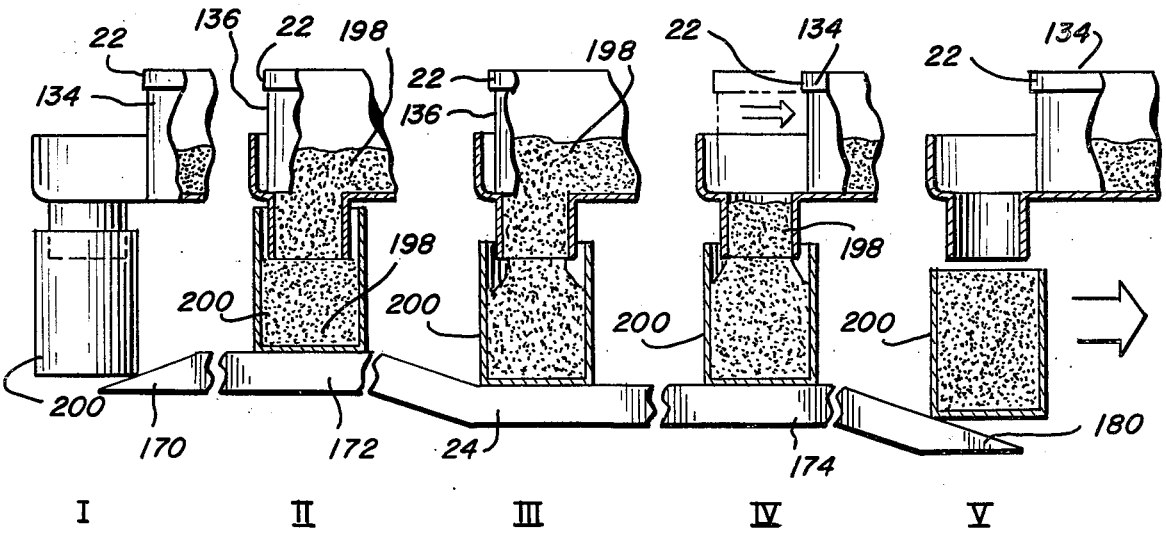
FIG. 9

APPARATUS FOR FILLING CONTAINERS

BACKGROUND OF THE INVENTION

Apparatus for filling open ended containers with free flowing powdered or granular materials is well known. The powdered or granular materials include a broad range of food products, including milk products, condiments, tea, sugar, salt, cocoa, rice, seeds, chopped vegetables as well as chemicals including cleansers, detergents, insecticides, lyes, crystals and the like. An apparatus of this general type is disclosed in U.S. Pat. No. 3,967,659 issued to John R. Nalback Engineering Co., Inc. and in U.S. Pat. No. 3,967,662 issued to John R. Nalbach Engineering Co. Inc. Apparatus of this type has found wide acceptance in the food industry, chemical industry, and cosmetic industry for packing all manner of divided material in powdered or granular form.

Older devices of this general type employ starwheels in the operation of the apparatus. These starwheels operate in a satisfactory manner for one particular size container. If a different size container is desired to be used, a filler disc which meets with the starwheel must be changed in order to fill cans having a different size or volume. When this filler disc is changed a smaller size container can be accommodated in the machine. However the center-to-center distances between each of the filling apertures in the filler discs remain the same, thus necessitating that the same number of cans be fed through the machine regardless of can size. This renders the machine inefficient for use over a wide variety of ranges of container sizes since it is desired that the machine fill an optimum number of cans regardless of can size for each unit of time for which the machine is operating.

It is desirable to have a machine which would provide optimum filling rates for a variety of dissimilar container sizes. The machine would thus eliminate the need for starwheels and provide for easy cleaning.

SUMMARY OF THE INVENTION

The present invention relates to an improved construction for an apparatus used in filling like containers with a like measured amount of powdered, granular or discrete material. The apparatus includes a base with a drive mounted in its lower portion. A feed system is also mounted on the base. The base also has mounted thereon a jack having fixed and movable portions and a removable rotary dispenser drivingly connected to the drive. The removable rotary dispenser includes a plurality of measuring flasks connected to a rotatable disc. A material reservoir is mounted in engagement with the removable rotary dispenser. The material reservoir includes a wall section of a tank, the bottom section of which is completed by a portion of the removable rotary dispenser. The material reservoir is movable in a vertical direction with the movable portion of the jack to allow the removable rotary dispenser to be quickly and easily changed. The measuring flasks are arranged in a circle. The circle has its center positioned concentric with a center of an axis of rotation of the removable rotary dispenser.

A ring wheel has a plurality of container pockets defined by a plurality of regularly spaced fins. Each of the container pockets is positioned adjacent a filler tube for reception of a measuring flask. The container pockets move at the same velocity as the container flasks to maintain the container pockets in registry with respective flasks for carrying containers positioned in the pockets.

A straight-line input conveyor is positioned in a horizontal attitude. One end of the straight-line conveyor enters the housing and delivers empty containers in a J-path toward the filling turrets. The J-path of the input disc intersects a circular path of the container pockets. The container pocket then carries the empty container along a container elevator. The container elevator raises the empty container into a telescoping relationship with its respective measuring flask so that the container provides a bottom or catcher for material in the measuring flask. The container is carried to an arcuate container support which is parallel to the path of movement of the container. A measured amount of material is delivered to the empty container from each respective measuring flask. The measuring flasks then sweep out from underneath a wall of the tank to limit the amount of material deposited in the measuring flasks and thereby in the containers. The arcuate container support includes a downwardly sloping elevator portion so that the container is gradually moved down relative to its respective measuring flask to allow material in the flask to be deposited in the container.

Thus, the containers are filled with a desired measured amount of material. The containers are carried along the ring wheel by their respective container pockets to a point where the containers leave the ring wheel and are deposited at an output station.

The output station can be a straight-line path which path is tangential to the circular path of the container pockets. The output station can also be parallel to the input conveyor or can be immediately adjacent thereto. Accordingly, the instant apparatus provides a means for filling empty containers with a powdered or granular material and allowing a variety of container sizes to be filled quickly and efficiently.

It is a principal object of the present invention to provide an improved apparatus for filling containers which apparatus allows quick and easy changing of the rotary removable dispenser.

It is still another object of the herein disclosed invention to provide an apparatus for filling like containers in which the like containers are automatically and surely introduced into the apparatus without using a starwheel in the apparatus.

It is a still further object of the instant invention to provide an improved container filling apparatus in which granular or powdered material is delivered uniformly to the containers in a prescribed amount.

Other objects and uses of the present invention will become readily apparent to those skilled in the art upon a perusal of the following specification and claims in light of the accompanying drawings.

BRIEF DESCRIPTION OF THE DRAWINGS

FIG. 5 is a top view of the container filling apparatus of FIG. 1 having portions shown in phantom to show details of a drive and a jack;

FIG. 6 is an enlarged fragmentary cross-sectional view of the apparatus for filling containers of FIG. 1 showing details of the relationship between the removable rotary dispenser and containers carried beneath the removable rotary dispenser;

FIG. 8 is a schematic view of a plurality of filling stations of the apparatus for filling containers of FIG. 1, showing details of the relative vertical elevation of the container as it passes around the filling stations; and FIG. 9 includes a series of cross-sectional views taken at each of the respective stations identified in FIG. 8 showing details of the filling procedure as the container sweeps around a periphery of the container filling apparatus.

DESCRIPTION OF THE PREFERRED EMBODIMENT

Figure 1:
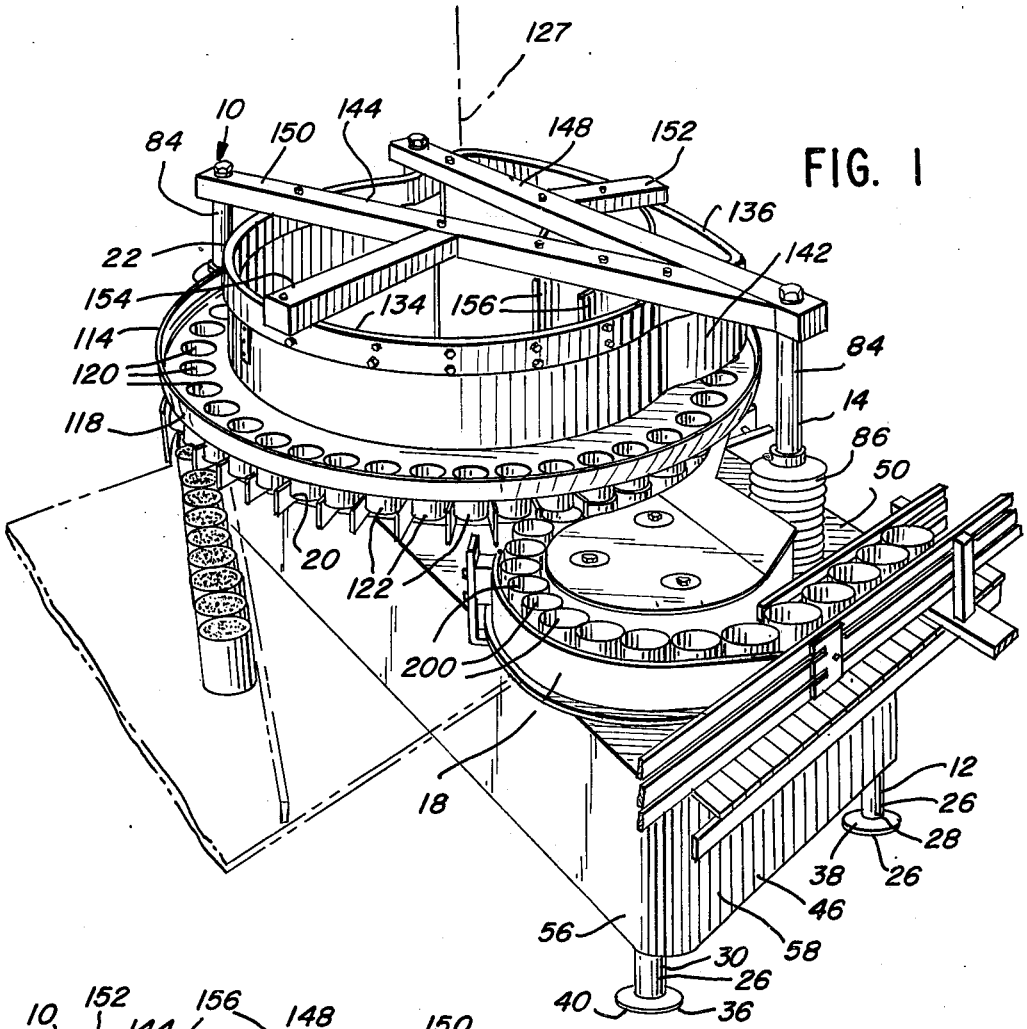
FIG. 1 is a perspective view of an apparatus for filling containers embodying the present invention in an operative environment.
Figure 7:
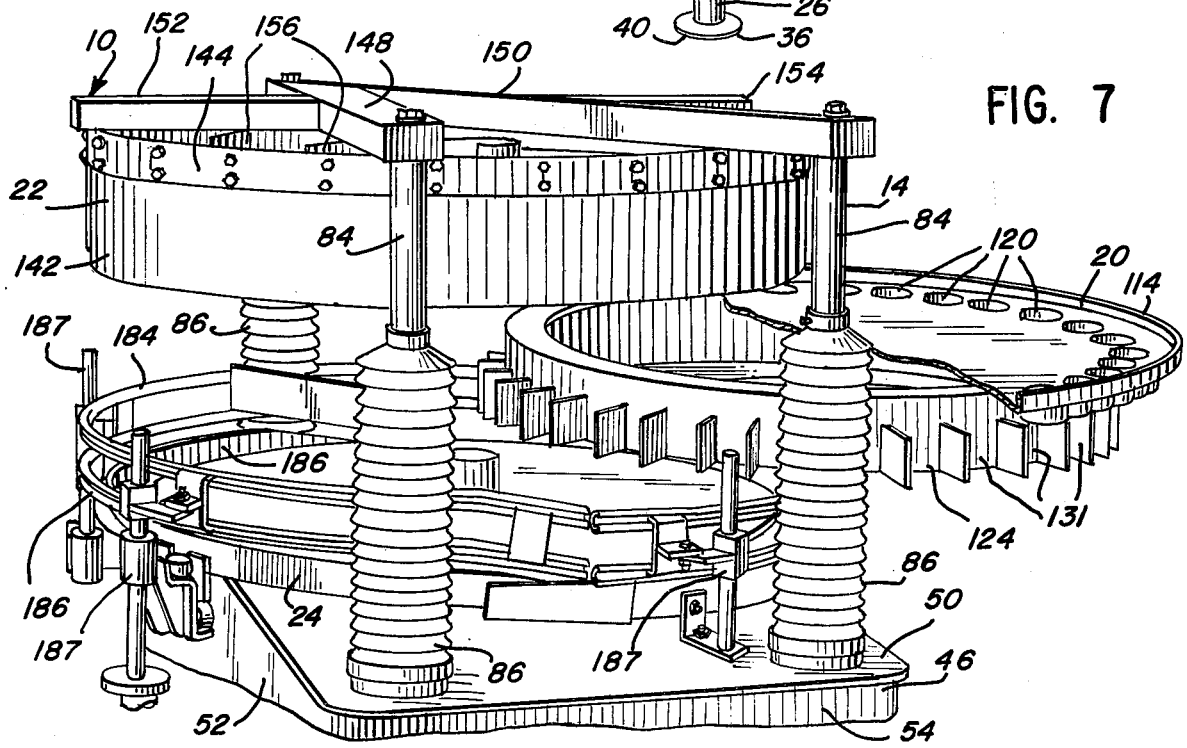
FIG. 7 is a perspective view of the apparatus for filling containers of FIG. 1 having portions broken away to show a material reservoir in a raised position and showing the removable rotary dispenser as it is being removed from the container filling apparatus for changing.
Figure 2:
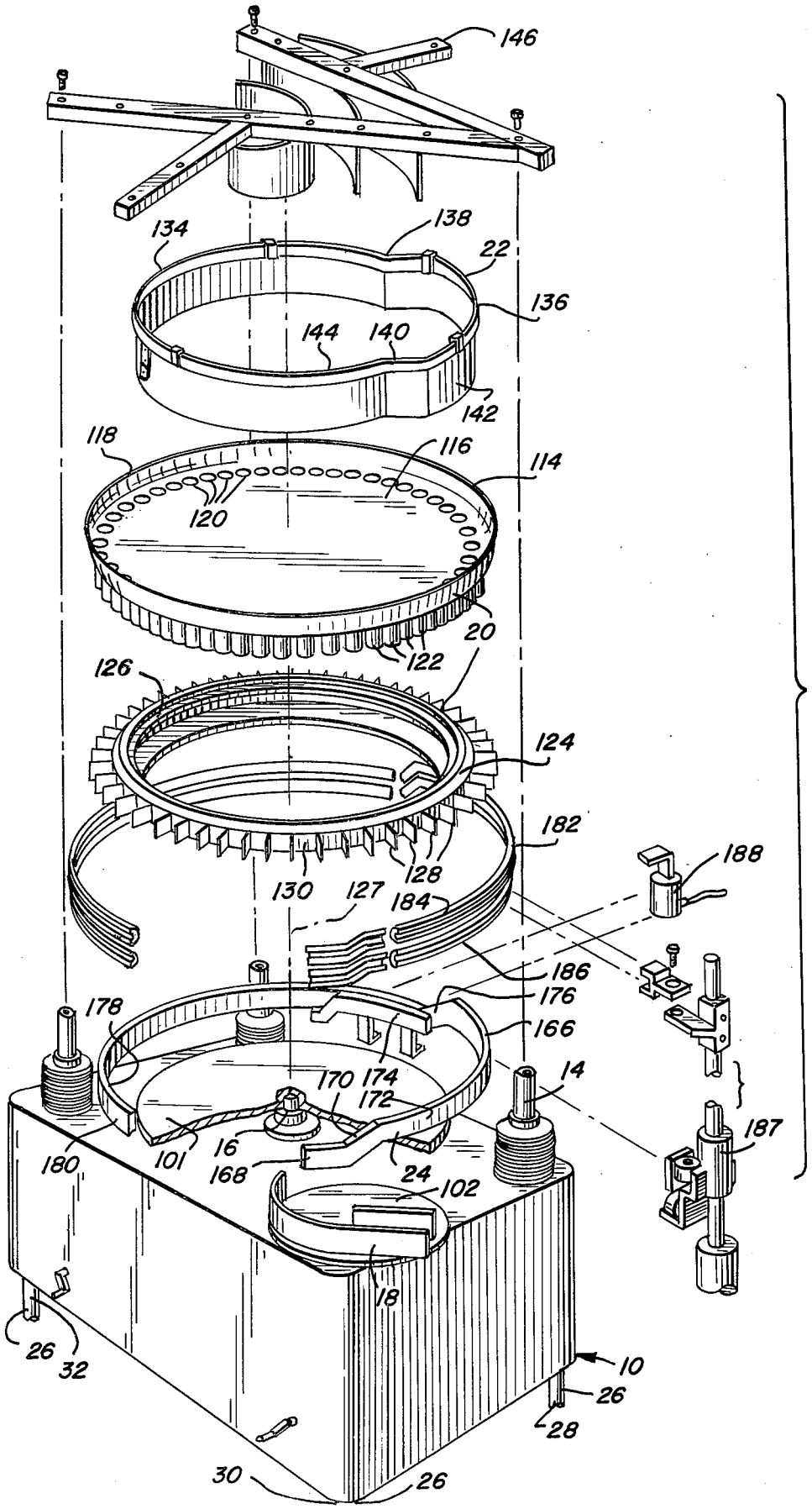
FIG. 2 is an exploded view of the apparatus for filling containers shown in FIG. 1.
Figure 3:
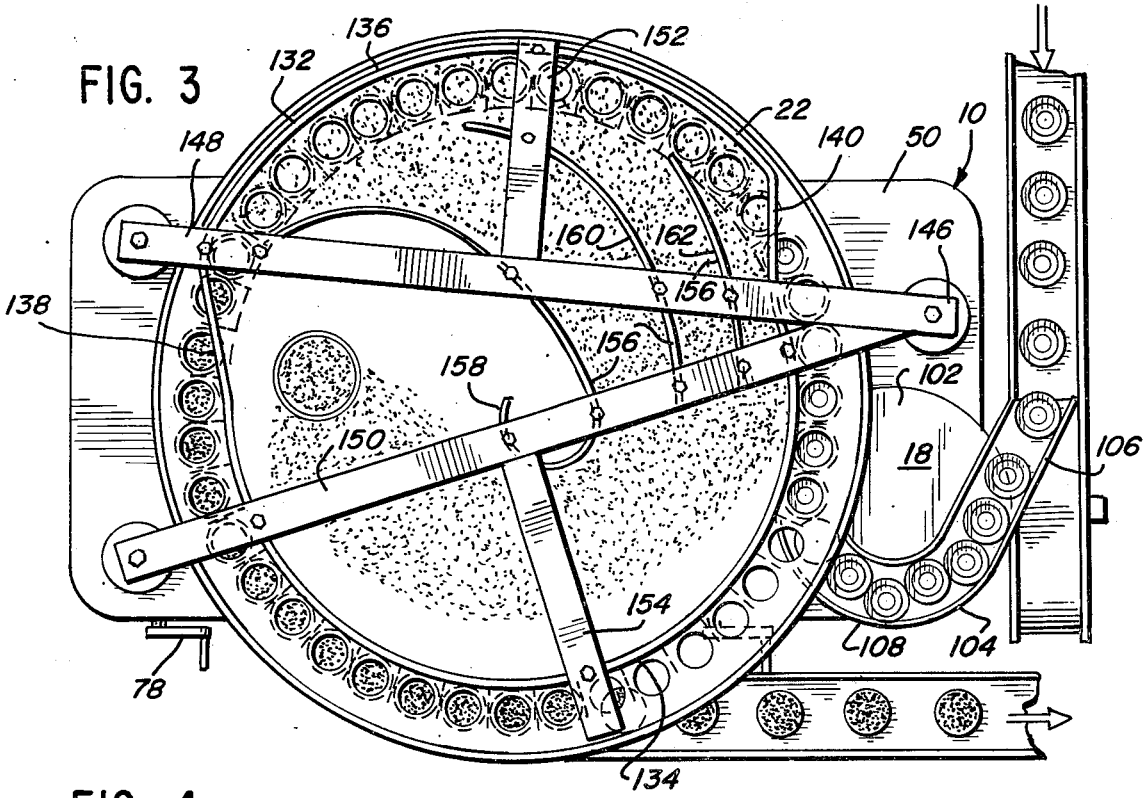
FIG. 3 is a top elevational view of the apparatus for filling containers shown in FIG. 1.
Figure 4:
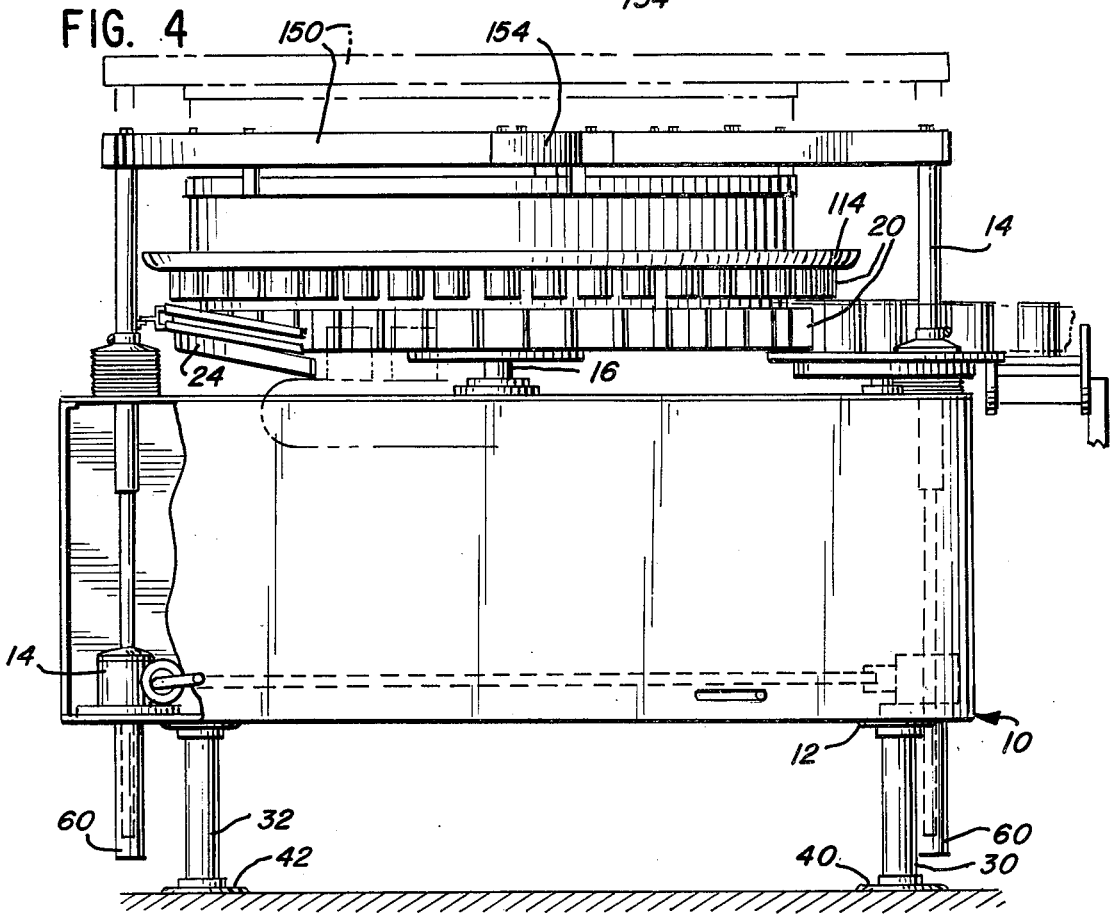
FIG. 4 is a side elevational view of the apparatus for filling containers of FIG. 1.

Referring now to the drawings and in particular to FIGS. 1 and 2, a container filling apparatus embodying the present invention is generally indicated therein by a numeral 10. Container filling apparatus 10 has a base 12. A jack 14 is mounted on base 12. A drive 16 is also mounted on base 12. A feed system 18 is mounted on base 12. Feed system is connected to drive 16. A removable rotary dispenser 30 is drivingly connected to drive 16. A material reservoir 22 is connected to jack 14 and removable rotary dispenser 20. A container elevator 24 is mounted on base 12.

Base 12 is a generally rectangular base. Base 12 has a plurality of four base legs extending perpendicularly therefrom, generally indicated by number 26. Base legs 26 include a first leg 28, a second leg 30 and a third leg 32 shown in the drawings. A plurality of feet, generally indicated by numeral 36 is connected to legs 26. A foot 38 is connected to leg 28. A foot 40 is connected to leg 30. A foot 42 is connected to leg 32.

A rectangular housing 46 is mounted on base 12. Rectangular housing 46 includes a bottom housing wall 48, a top housing wall 50, a first sidewall 52, a second sidewall 54, a third sidewall 56, and a fourth sidewall 58. The sidewalls are joined at a plurality of rounded corners 59. A plurality of jack strut sleeves 60 extend from bottom wall 48.

Jack 14 is connected to base 12 and is partially mounted within housing 46, as can be seen in FIG. 5 of the drawings. Jack 14 includes a first jacking point 66, a second jacking point 68 and a third jacking point 70. Taking jack point 66 as the exemplary jack point, jack point 66 is also a driving jack point. Jack point 66 has a base plate 72 which is connected to a portion of the bottom of housing 46 by a plurality of bolts 74. Base plate 72 is a rectangular base plate. A horizontally positioned gearbox 76 is connected to base plate 72. A crank 78 is connected to horizontally positioned gearbox 76. Gear assembly 76 is driven through a drive shaft 80 by crank 78. A vertical cylindrical housing 82 receives a jacking strut 84. Vertical cylindrical housing 82 is drivingly connected to gear assembly 76. Jacking strut 84 is positioned pependicular to bottom wall 48 of housing 46. A bellows 86 is connected between top wall 50 of housing 46 and jack strut 84. Bellows 86 is a conventional rubber or plastic bellows and seals jack strut 84 partially enclosed within housing 46. Jack strut 84 extends into one of jack strut sleeves 60. Jack points 68 and 70 also have jack struts 84 which are driven through a differential 87 and a universal joint drive shaft 88 from jack point 66.

Drive 16 includes an electric motor 89 connected to base 12. Electric motor 89 is a conventional electric motor, which is in turn connected to a transmission 90. Transmission 90 is, in turn, connected to a feed system gear 94. Feed system gear 94 is drivingly connected to a drive gear 96. Drive sprocket 96 is connected by a chain 98 to a dispenser drive sprocket 100. Dispenser drive sprocket 100 is positioned approximately midway within housing 46. A circular bottom plate 101 is connected to drive sprocket 100.

Feed system 18 is connected to feed system drive gear 94. A circular rotary disc 102 is connected to drive gear 94. Rotary disc 102 rotates with drive gear 94. A J-chute 104 has a straight section 106 and a curved section 108 formed integral therewith. Curved section 108 has approximately the same radius of curvature as the circular rotary disc.

Removable rotary dispenser 20 includes a filler disc 114. Filler disc 114 is a circular filler disc and includes a central circular disc section 116. A substantially perpendicular rim 118 is formed integral with and perpendicular to disc 116. A plurality of circular apertures 120, arranged about a radius of disc 116, penetrate through disc 116. A plurality of right circular cylindrical filler tubes 122 is formed integral with disc 116 opposite rim 114. Cylindrical filler tubes 122 are positioned substantially perpendicular to disc 116 and positioned in registry with respective apertures of plurality of apertures 120.

A ring wheel 124 is removably connected to filler disc 114. Ring wheel 124 includes a contral ring or toroidal section 126. Central ring section 126 has an outer radius slightly smaller than the radius of the apertures 120 of filler disc 114 from an axis of rotation 127 of filler disc 114. A plurality of substantially rectangular thin fins 128 is formed perpendicular to an outside wall 130 of ring 126. Each fin of plurality of fins 128 is positioned substantially perpendicular to the point on outside wall 130 to which it is attached. In addition, fins 128 are regularly spaced about outside wall 130 so that filler tubes 122 may be easily positioned in registry between successive pairs of fins 128. Fins 128 define a plurality of container pockets 131.

Material reservoir 22 includes a vertical tank wall 132. Vertical tank wall 132 has a pair of radius sections respectively numbered 134 and 136. Radius 134 is slightly smaller than radius 136. A pair of relatively straight wall sections 138 and 140 is formed integral with radius sections 134 and 136. A bottom portion of tank wall 132 is composed of a flexible plastic wall 142 adapted for sealing slideable connection with disc 116 of filler disc 114. A metal reinforcing ring 144 is connected to plastic wall 142 opposite filler disc 114 to supply rigidity to plastic wall 142.

An A-frame reservoir head 146 is mounted immediately above tank wall 132 perpendicular to axis of rotation 127. A-frame 146 has a pair of elongated rectangular legs respectively numbered 148 and 150. Legs 148 and 150 are connected at one end and define an acute angle. Leg 150 is slightly shorter than leg 148. Legs 148 and 150 receive jack struts 84. A pair of shorter legs, respectively numbered 152 and 154, is positioned perpendicular with and substantially midway along outer sides of legs 148 and 150. Legs 148, 150, 152 and 154 are all connected to reinforcing ring 144 of reservoir 22. A plurality of vanes 156 is connected to A-frame 146. Plurality of vanes 156 includes a first sharply curved vane 158, a second vane 160 and third relatively straight vane 162. Vanes 156 have a width slightly less than a height of tank wall 132.

Container elevator 24 is positioned about bottom plate 101. Container elevator 24 includes a support rib 166. Support 166 has a short intake step 168. Elevator ramp step 170 is formed integral with and immediately adjacent to short intake step 168. An elongated elevator step 172 is formed at an angle to step 170. A movable step 174 having a ramp section 176 is connected to section 172. Movable section 174 is vertically movable independent of the other portions of support rib 166, to allow volume control for various size containers. A final drop section 178 is formed integral with movable section 174. An exit step 180 is formed integral with final drop section 178.

A dual semi-tubular guide bar 182 is connected to housing 46 and positioned around container elevator 24. Guide bar 182 has a first semi-tubular slotted guide bar rail 186 is positioned immediately adjacent to first rail 184. A plurality of guide bar supports 187 connects guide bar 182 to housing 46. A vibrator 188 is attached to elevator 24.

In use, divided matter 198 is placed in reservoir 22. A plurality of like size empty containers 200 is fed through J-chute 104, along rotary disc 102, and onto intake step 168 of elevator 24. As each container 200 reaches the removable filler disc, each container is received in a pocket 131 between a respective pair of ring wheel fins 128. The ring wheel fins 128 hold each container under an adjacent cylindrical filling tube or measuring flask 122. The containers are carried in a curved path by rotation of the ring wheel 124 about its axis of rotation 127. As the containers are swept along by the ring wheel fins 128, the containers slide up step 170 of elevator 24 and are positioned in filling proximity with one of the filling tubes 122. The containers 200 are then vibrated as divided matter 198 drops through the filling tube 122 into container 200.

Since the filler disc is swept around the radially fixed tank wall, the tank wall appears to sweep back and forth radially in a moving frame of reference of the container being filled. Thus, the container is introduced and begins moving along step 168 and up step 170. Once the container 200 is on top of step 172, the tank wall sweeps outward and allows divided matter to fall in container 200. While the container traverses portion 174 of elevator 24, the tank wall sweeps inward radially, leaving the respective filling tube filled to aperture 120 and container 200 partially filled with divided matter. The container 200 then drops down a step thereby emptying a predetermined volume from filling tube 122 into the remaining space in container 200. Container 200 is then deposited in an output station.

The plurality of vanes 156, connected to A-frame 146 keeps the divided matter 198 positioned immediately adjacent the active filling tubes, as the filler disc is rotating, to ensure that each container 200 receives a full charge of divided material. The vibrator 188 is positioned along the filling portion 172 of elevator 24 so that container 200 is vibrated to ensure that voids are not formed in the divided material and to ensure that container 200 is properly filled.

The volumetric nature of filling flasks 122 ensure that each container receives a full charge of divided matter while at the same time allowing each of the filling tubes 122 to be completely emptied into a container 200 upon each revolution of filler disc 114 so that there is no divided matter remaining in the filler tubes to be spilled out of the filler tubes and onto the machine. Reservoir 22 comprises an open head filling apparatus which is easily kept filled with divided matter by a machine operator while the machine is running.

If it becomes necessary to change the container sizes of the containers which are being filled in the apparatus, this is quickly and easily accomplished. Crank 78 of jack 14 is turned and raises struts 84, thereby lifting A-frame 146 parallel to the axis of rotation 127 of the rotary removable dispenser 20. Reservoir 22 is lifted away from the rotary removable dispenser 20 by A-frame 146. The rotary removable dispenser 20, including both filler disc 114 and ring wheel 124, is then quickly and easily removed from the drive of the apparatus. Bottom plate 101 is left in engagement with the apparatus. A replacement filler disc and ring wheel assembly are then dropped back into position and connected to bottom plate 101. The crank 78 of jack 14 is then turned in the opposite direction to lower reservoir 22 back into contact with disc 116 of new filler disc 114 of the new rotary removable dispenser.

In this way, a variety of can sizes can be used with a single apparatus. It should be noted that fins 124 of the ring wheel are relatively thin and spaced at equidistant intervals about the ring wheel 124. The fins 128 are positioned so that a maximum number of a particular or selected container size may be accommodted by the ring wheel. Thus, the removable rotary dispenser provides a ring wheel which accommodates a maximum number of cans of any size within a selected size range. Therefore, the apparatus can be run at maximum efficiency with any size container which it can accommodate. This feature is not found in the art since filling machines in use presently, while being able to accommodate various size cans, are only able to fill the same number of cans, whether the cans ar large or small, during a filling cycle of the machine. Thus, each diameter can has a rotary removable dispenser associated with it for use in conjunction with the apparatus.

One can appreciate then, that the container filling apparatus of the present invention provides a container filling apparatus in which a removable rotary dispenser allows maximum efficiency for filling various size containers by providing for ready replacement of the removable rotary dispenser. Each of the containers is also filled to the top of the container without spilling since the volumetric filling flasks 122 provide preselected volume filling for respective containers. The apparatus, through its open head reservoir, also is adapted to be run continuously. Divided matter 198 can be added during machine operation without the necessity of halting machine operation for refilling of the reservoir 22.

Although a specific embodiment of the herein-disclosed invention has been described in detail, it is readily apparent that those skilled in the art may make various modifications and changes in the present invention without departing from the spirit and scope of the present invention. Therefore, the present invention is limited only by the appended claims.

What is claimed is:

1. An apparatus for filling like containers with a like amount of divided material, comprising: a base; a drive mounted on said base; a material reservoir for holding divided material connected to said base; a plurality of interchangeable rotary dispensers, each of said rotary dispensers being adapted for driving connection to the drive and to receive divided material from the reservoir when connected to the drive, each of said interchangeable rotary dispensers being adapted to receive removably a container of a given size different from the size container receivable by each of the other rotary dispensers of the plurality, each interchangeble rotary dispenser having a circular portion having a plurality of radially mounted vanes on its outer periphery and being spaced an equal distance from adjacent vanes on the circular portion, each of said vanes being relatively thin at its outer edge, the vanes of each of the interchangeable rotary dispensers being spaced apart from each other a distance sufficiently great to receive a container of a given size different from the container received between the vanes of each of the other interchangeable rotary dispensers of the plurality to hold the containers in a portion of a circle, a filler tube positioned between each pair of vanes, each of the filler tubes of one rotary dispenser being identical to each other filler tube of that rotary dispenser and different than the filler tubes on each of the other rotary dispensers of the plurality, each of said filler tubes being adapted to deliver a predetermined amount of divided material into a container of a given size held between its respective vanes, a selected one of said interchangeable rotary dispensers being drivingly connected to the drive and being rotatably positioned below the material reservoir to rotate relative to the material reservoir to receive said divided material into its respective filler tubes from the material reservoir while the remainder of the rotary dispensers of the plurality are disposed in an inoperative attitude; and a feed connected to the base to deliver empty like-sized containers to the selected rotary dispenser connected to the drive, whereby said selected one of said rotary dispensers being drivingly connected to the drive below the material reservoir to receive a maximum number of containers of a given size may be disconnected from the drive and removed from below the material reservoir and replaced by another one of the plurality of rotary dispensers to be connected to the drive below the material reservoir to receive a maximum number of containers of another size.

2. An apparatus for filling like containers with a like amount of divided material, as defined in claim 1, including a jack mounted on said base, a first portion of said jack being fixed with respect to said base, a second portion of said jack being movable with respect to said base, said second portion of said jack being connected to said material reservoir, said material reservoir being movable with said second portion of said jack substantially parallel to an axis of rotation of said removable rotary dispenser connected to said drive.

3. An apparatus for filling like containers with a like amount of divided material, as defined in claim 1, wherein a portion of said feed is rotatably drivably connected to said drive.

4. An apparatus for filling like containers with a like amount of divided material, as defined in claim 1, including a container elevator connected to said base, said container elevator being adapted to move each like container into engagement with said removable rotary dispenser for filling with said divided material.

5. An apparatus for filling like containers with a like amount of divided material, comprising: a base; a drive mounted on said base; a material reservoir for holding divided material connected to said base; and a removable rotary dispenser positioned below the material reservoir and being connected to the drive to be rotated thereby, said removable rotary dispenser having a circular portion with a plurality of vanes at its outer periphery, each of said vanes being relatively thin at its outer edge, said vanes being spaced apart from each other a distance sufficiently great to receive between a pair of adjacent vanes one of said like containers of a given size to hold the container in a portion of a circle proximate to adjacent containers, said rotary dispenser having an identical filler tube positioned between each pair of adjacent vanes, each of said filler tubes being positioned below the material reservoir to receive divided material from the reservoir and to deliver a given amount of divided material to a container positioned between its respective vanes; and a feed connected to said base to deliver containers to the rotary dispenser.

6. An apparatus for filling like containers with a like amount of divided material, as defined in claim 5, including a jack mounted on said base, a first portion of said jack being fixed with respect to said base, a second portion of said jack being movable with respect to said base, said second portion of said jack being connected to said material reservoir, said material reservoir being movable with said second portion of said jack substantially parallel to an axis of rotation of said removable rotary dispenser.

7. An apparatus for filling like containers with a like amount of divided material, as defined in claim 5, wherein said feed is drivably connected to said drive.

8. An apparatus for filling like containers with a like amount of divided material, as defined in claim 5, including a container elevator connected to said base, said container elevator being adapted to move each like container of said plurality into engagement with said removable rotary dispenser for filling with said divided material.

9. An apparatus for filling like containers with a like amount of divided material, comprising: a base; a jack mounted on said base, a first portion of said jack being fixed with respect to said base, a second portion of said jack being movable with respect to said base; a drive mounted on said base; a feed system mounted on said base, a portion of said feed system being drivably connected to said drive, said feed system being adapted to receive a plurality of like containers for filling; a removable rotary dispenser drivably connected to said drive, said removable rotary dispenser having an axis of rotation, said removable rotary dispenser being circular and having a plurality of thin wall pockets on its outer periphery to receive a maximum of said like containers from said feed system in the thin wall pockets, said rotary dispenser having a filler tube positioned in each pocket, each filler tube being parallel to the axis of rotation; a material reservoir connected to said second portion of said jack, said material reservoir being movable with said second portion of said jack substantially parallel to said axis of rotation of said removable rotary dispenser, said material reservoir being positioned above said removable rotary dispenser to feed divided material to said like containers through the respective filler tubes, said material reservoir being movable in a direction parallel to said axis of rotation of said removable rotary dispenser to allow ready removal of said removable rotary dispenser and replacement with a similar removable rotary dispenser; and a container elevator connected to said base, said container elevator being adapted to move each like container of said plurality into engagement with said removable rotary dispenser for filling with said divided material.

10. An apparatus for filling like containers with a like amount of divided material, as defined in claim 9, wherein said material reservoir includes a tank wall, having a pair of radially curved sections and a pair of straight sections, said radially curved sections respectively having a first radius of curvature and a second radius of curvature.

11. An apparatus for filling like containers with a like amount of divided material, as defined in claim 9, wherein said first portion of said jack includes a plurality of gear housings connected to a differential and to said second portion of said jack.

12. An apparatus for filling like containers with a like amount of divided material, as defined in claim 11, in which said differential is connected to one of said gear housings by a universal joint.

13. An apparatus for filling like containers with a like amount of divided material, as defined in claim 9, wherein said second portion of said jack includes a plurality of jack struts adapted to move substantially parallel to said axis of rotation of said removable rotary dispenser.

14. An apparatus for filling like containers with a like measured amount of divided matter, comprising: a base, said base having a substantially rectangular housing affixed thereto, said substantially rectangular housing having a plurality of rounded corners; a manually operated jack, having a first jacking point mounted in said housing, a second jacking point mounted in said housing, and a third jacking pooint mounted in said housing, each of said jacking points having a gear box, said first jacking point bear box being connected to an external crank, said first jacking point gear box being connected through a first jack drive shaft to a differential, said differential being connected to said gear box of said second jacking point, said differential being connected through a universal joint and a drive shaft to said gear box of said third jack point, each of said jack points having a respective jacking strut, each jacking strut being positioned parallel to said other jacking struts, each of said jacking struts being adapted to be moved parallel to a long axis of each of said jacking struts; a drive mounted on said frame of said base, said drive having an electric motor, said electric motor being drivingly connected to a transmission, said transmission being drivingly connected through a chain to a main drive gear, said transmission also being drivingly connected to a feed system drive gear; a feed system mounted on said base, said feed system including a feed disc, said feed disc being a circular disc rotatably drivingly connected to said feed system drive gear of said drive, said feed system including a curved chute, positioned adjacent to said feed disc, said curved chute and said feed disc being adapted to receive a plurality of like containers for filling; a removable rotary dispenser, drivingly connected to said main drive gear of said drive, said rotary removable dispenser having a toroidal ring section, said toroidal ring section having a plurality of identical thin rectangular fins formed integral with, and perpendicular to, an outside wall of said toroidal ring section at regular intervals, said identical thin rectangular fins defining a plurality of container pockets, a filler disc dispenser removably connected to said ring wheel, said filler disc dispenser having a circular disc body, having a perpendicular rim formed integral therewith, said circular disc body having a plurality of circular filling apertures disposed in a circle immediately adjacent to said rim, a plurality of right circular cylindrical filling flasks connected to said circular disc body, in registry with respective filling apertures, said right circular cylindrical filling flasks of said filler disc being positioned in registry between respective fins of said toroidal ring section, said toroidal ring section and said filler disc each having an axis of rotation, said axis of rotation being positioned substantially parallel to said struts of said jack, said removable rotary dispenser being adaped to receive said plurality of like containers between said fins and in said container pockets of said toroidal ring section from said feed system; a material reservoir, having an A-frame connected to said struts of said jack, said material reservoir being movable with said A-frame and said struts of said jack substantially parallel to said axis of rotation of said removable rotary dispenser, said material reservoir being positioned above said rotary removable dispenser to feed said divided matter to said containers, said material reservoir including a plurality of vanes connected to said A-frame, said A-frame lying in a plane perpendicular to said axis of rotation of said removable rotary dispenser, a tank wall connected to said A-frame, said tank wall being positioned perpendicular to said A-frame, said tank wall including a lower plastic wall section, being adapted for contact with said filling disc, and an upper reinforcing section, connected by a plurality of connectors to said lower plastic wall section, a curved portion of said upper reinforcing section and lower plastic wall section being positioned along a first radius of curvature, having a center concentric with said axis of rotation of said removable rotary dispenser, a second curved portion of said tank wall being formed along a second radius of curvature, having a center concentric with said axis of rotation of said removable rotary dispenser, said tank wall including a pair of straight sections connecting said first curved portion to said second curved portion, said material reservoir being movable along said axis of rotation of said removable rotary dispenser to allow ready removal of said removable rotary dispenser and replacement with a similar removable rotary dispenser; and a container elevator mounted on said housing, said container elevator being adapted to move each like container of said plurality of containers into engagement with a respective filling flask of said filler disc for filling with divided matter.

* * * * *

UNITED STATES PATENT OFFICE

CERTIFICATE OF CORRECTION

Patent No. 4,122,876 Dated October 31, 1978

Inventor(s) John C. Nalbach

It is certified that error appears in the above-identified patent and that said Letters Patent are hereby corrected as shown below:

Column 3, line 30, after "system" insert -- 18 --.

Column 3, line 31, cancel "30" and substitute -- 20 --.

Column 5, line 24, after the first recitation of "rail" insert -- 184. A second parallel semi-tubular slotted guide bar rail --.

Column 6, line 42, cancel "ar" and substitute -- are --.

Column 9, line 34, cancel "pooint" and substitute -- point --.

Column 9, line 36, cancel "bear" and substitute -- gear --.

Signed and Sealed this

Tenth Day of July 1979

[SEAL]

Attest:

LUTRELLE F. PARKER

Attesting Officer

Acting Commissioner of Patents and Trademarks